United States Patent [19]

Ahrens et al.

[11] Patent Number: 4,484,738

[45] Date of Patent: Nov. 27, 1984

[54] PLAYGROUND DECK

[75] Inventors: Paul W. Ahrens; Randy R. Juhl; Larry D. Kunce; Wayne E. Katzer, all of Grinnell, Iowa

[73] Assignee: Miracle Recreation Equipment Company, Grinnell, Iowa

[21] Appl. No.: 382,346

[22] Filed: May 26, 1982

[51] Int. Cl.[3] ..... A63B 17/00; A63G 21/00

[52] U.S. Cl. ..... 272/56.5 R; 52/282

[58] Field of Search ..... 272/56.5 R, 113; D21/235, 242, 243, 244; 52/282, 273, 239; 256/24, 25, 27, 28, 29, 30, 31, 73

[56] References Cited

U.S. PATENT DOCUMENTS

| | | | |
|---|---|---|---|
| D. 238,694 | 2/1976 | Jamison | 272/56.5 R |
| D. 241,664 | 9/1976 | Ewers et al. | D21/244 |
| 2,204,319 | 6/1940 | Parsons et al. | 52/282 X |
| 2,206,581 | 7/1940 | Shapiro | 272/113 |
| 3,137,967 | 6/1964 | Fleith | 52/282 X |
| 3,194,361 | 7/1965 | Thurman | 256/24 X |
| 3,516,659 | 6/1970 | Kleid | 272/56.5 R X |
| 3,729,881 | 5/1973 | Disko | 52/282 X |

*Primary Examiner*—Robert A. Hafer
*Assistant Examiner*—Arnold W. Kramer
*Attorney, Agent, or Firm*—Zarley, McKee, Thomte, Voorhees & Sease

[57] ABSTRACT

A playground deck of all metal construction includes common components, a platform around which walls are formed from a combination of corner panels having right angle wing sections and single panels substantially the size of a wing section and center panels. A passageway between opposing wing sections and/or single panels is provided for access to playground pieces such as slides or steps. The center panels are removable and close unused passageways.

24 Claims, 6 Drawing Figures

PLAYGROUND DECK

BACKGROUND OF THE INVENTION

Playground equipment should be versatile allowing for numerous design configurations using a minimum number of manufactured parts. The equipment should be safe to use and thus include no sharp edges from which users can be injured. The equipment should be easily assembled and disassembled and yet not invite disassembly by users of the equipment.

SUMMARY OF THE INVENTION

The playground deck of this invention utilizes basically three components common to one or more deck sections. These components include corner panels with wing sections at 90° to each other and single panels approximately the size of a wing section and center panels which may be positioned between either oppositely disposed wing sections or wing sections and single panels. Each side of the deck will have an access passageway which may be temporarily closed by the center panel or which provide access to a slide or steps or the like. The platforms are of metal and include downwardly extending flanges around the perimeter which allows for easy solid connections to the corner panels, single panels, and center panels and to each other and in turn to the supporting posts.

DESCRIPTION OF THE PREFERRED EMBODIMENT

Figures 1, 2, 3, 4, 5, 6:
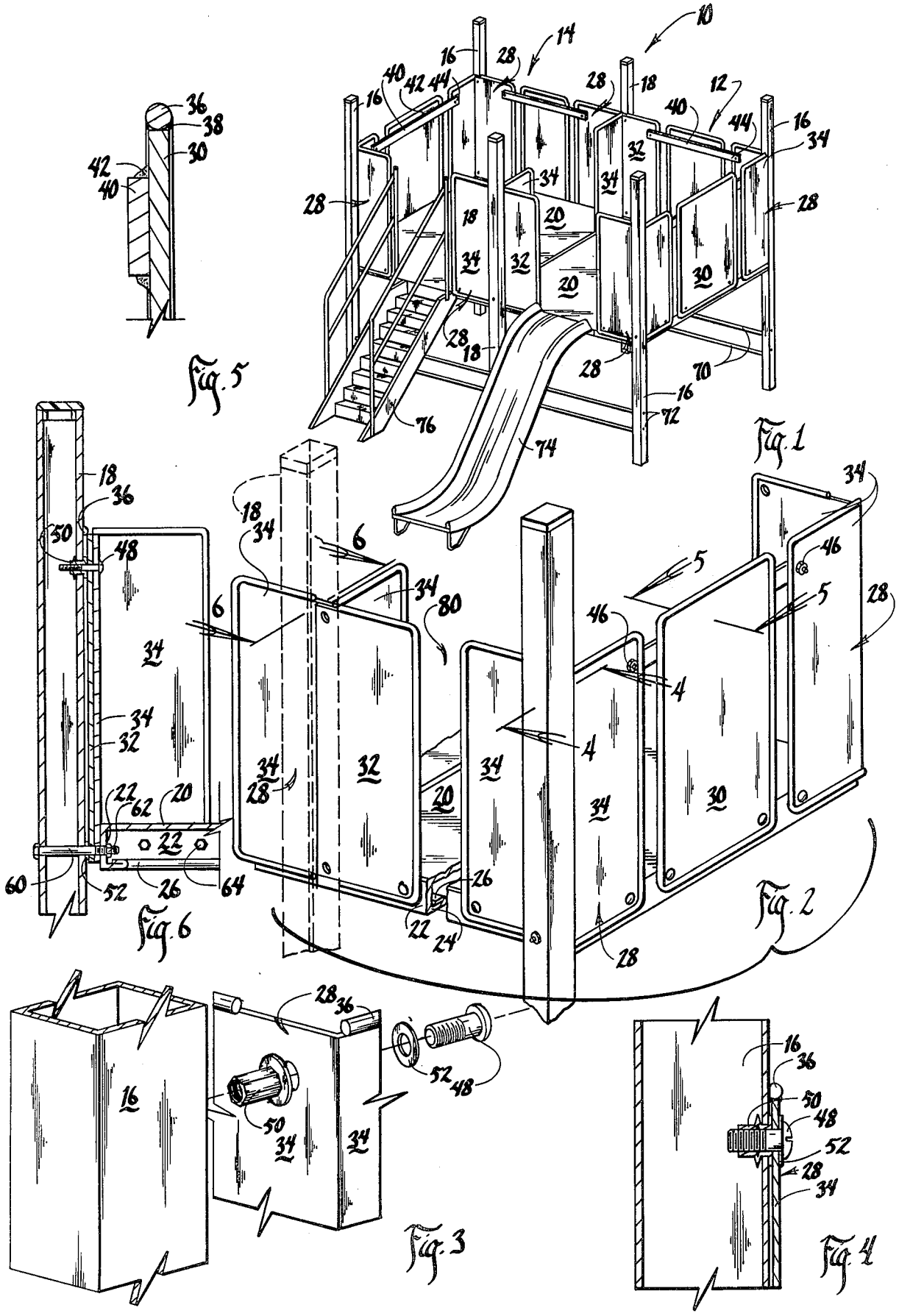
FIG. 1 is a perspective view of a representative playground deck including two deck sections.
FIG. 2 is a fragmentary perspective view on an enlarged scale.
FIG. 3 is an exploded perspective view of a corner panel being connected to a post.
FIG. 4 is a cross-sectional view taken along line 4—4 in FIG. 2.
FIG. 5 is a cross-sectional view taken along line 5—5 in FIG. 2.
FIG. 6 is a cross-sectional view taken along line 6—6 in FIG. 2.

The playground deck of this invention is referred to generally in FIG. 1 by the reference numeral 10 and includes deck sections 12 and 14 interconnected and supported by posts 16 at the corners and 18 in the center.

The deck section 12 has a metal floor 20 with a downwardly extending peripheral flange 22 which merges into an inwardly extending horizontal portion 24 which in turn terminates in a return bend portion 26 which presents a rounded edge to prevent any injury to the user by the elimination of all sharp edges.

The enclosure around the deck sections 12 and 14 comprises corner panels 28 on opposite sides of a center panel 30 and at corners where an existing corner panel is present then a single panel 32 is provided. The corner panels 28 include wing sections 34 which are the approximately area of the single panels 32.

To protect the users from being cut by sharp edges of the sheet metal making up the panels a rod 36 is secured by weldments 38 to the peripheral edges as seen in FIG. 5. A bracket 40 is also secured to the center panels 30 by weldments 42 and includes opposite ends 44 which are adapted to be bolted to wing sections 34 and the single panel 32 as seen in FIG. 1. The bolts 46 used as fasteners are seen in FIG. 2. In FIGS. 3 and 4, the wing section 34 of the corner panel 28 is seen fastened to the post 16 by a bolt 48 having a blind fastener 50 inside the post. A washer 52 is used on the bolt 48 between the bolt and the wing section 28.

In FIGS. 2 and 6, it is seen that the center post 18 has the corner panel 28 through its outside wing section 28 secured thereto along with the single panel 32 which is sandwiched against the post and against the wing section 34. The top end of the corner panel 28 and the single panel 32 are secured by the bolt 48 and the blind fastener 50 while the bottom end is secured by a bolt 60 which extends from the outside of the post 18 through the single panel 32 and then through the wing section 34 and then through the flange 22 of the platform 20 where it is held by a nut 62. The side-by-side platforms 20 are interconnected through their downwardly extending flanges 22 by bolts 64, as seen in FIG. 6 and are spaced apart the thickness of the wing section 34 of the corner panel 28.

The posts 16 and 18 below the platforms 20 of the deck sections 12 and 14 are interconnected by spaced apart horizontally extending rungs 70 tubular in form and secured to the post by bolts 72. As illustrated in FIG. 1, a slide 74 is connected to the platform 20 of the deck section 12 while steps 76 are connected to the platform 20 of the deck section 14.

In operation it is seen that any combination of structures may be created utilizing a wide variety of playground pieces. Common to each of the deck arrangements is that the platforms 20 will have sides made up of the combination of corner panels 28, center panels 30, and/or single panels 32 and passageways 80 are provided between oppositely disposed single panels 32 and wing sections 34 or between oppositely disposed wing sections 34 and these passageways may be utilized in providing access to the slide 74 or the steps 76 or be temporarily closed by the center panel 30. Again, unlimited flexibility is possible through the use of common components. The equipment is totally safe and injury proof due to all sharp edges having been eliminated by rounded surfaces being provided through use of the rods 36 around the edges of the sheet metal or the return bends 26 on the platform flanges 22. The totally metal construction of the equipment makes for long-lasting durable indestructible playground equipment.

I claim:

1. A playground deck comprising, a platform having a peripheral edge and being supported by corner posts which extend above said platform with each side of the said platform between a pair of corner posts including a corner panel attached to each of said pair of posts with each panel including wing panels extending along and above adjacent sides of said platform and one of said wing panels on each of said corner panels being positioned on the same side of said platform and being substantially spaced apart therebetween to provide passageways onto and off said platform, at least one of said passageways including a removable center panel substantially closing said passageway and being removable from said passageway without disassembly of the remainder of said deck, said center panel including a plate bracket extending adjacent the top and including oppositely disposed end portions overlapping said adjacent wing panels and being secured thereto by removable fasteners therethrough and the bottom of said center panel being secured by removable fasteners adjacent said edge of said platform.

2. The structure of claim 1 wherein another of said passageways is further defined as including steps leading to the ground.

3. The structure of claim 1 wherein another of said passageways is further defined as including a slide extending to the ground.

4. The structure of claim 1 wherein said platform, posts, center panels and corner panels are made from sheet metal.

5. The structure of claim 4 wherein said corner panels of sheet metal include a rod extending along the peripheral edge thereof to present a rounded surface to minimize the presence of sharp edges injurious to the users of the equipment.

6. The structure of claim 1 wherein said posts, platform, center panels and corner panels are made of metal and said posts are square for matingly engaging one wing portion of said corner panels.

7. The structure of claim 1 wherein said center panel is fastened at the bottom to said edge of said platform.

8. A playground deck comprising, a platform having a peripheral edge and being supported by corner posts which extend above said platform, a corner panel at each corner post and each corner panel including wing portions extending along adjacent edges of said platform and defining passageways onto and off said platform being formed between spaced apart wing portions on each side of said platform, said platform including two platform sections in side-by-side relationship with common edges being supported by a pair of common posts, said common posts including a corner panel with a wing portion of each of said corner panels being spaced apart and extending along said common edge thereby defining therebetween a passageway interconnecting said platform sections to provide an enlarged platform area, each of said common posts further including a single panel, said corner panels and said single panels providing wing-like portions extending in three directions from each common post.

9. The structure of claim 8 wherein said single panel is in overlapped relationship to said corner panel and is secured to said common post by common fasteners.

10. The structure of claim 9 wherein fasteners at the top end of said common posts include a blind fastener portion inside said common post and a male bolt portion extending through said single panel and one wing section of the corner panel into said post and engagement with said blind fastener portion and at the platform a bolt extends from the outer side of the post through the inner post wall, corner panel, single panel and the downwardly extending flange on the platform, and a nut means engage the inner bolt end inwardly of the downwardly extending flange.

11. The structure of claim 8 wherein one of said passageways includes a removable center panel substantially closing said passageway, said center panel including a plate bracket extending adjacent the top and including oppositely disposed end portions overlapping said adjacent wing panels and being secured thereto by removable fasteners and the bottom of said center panel being secured by removable fasteners adjacent said edge of said platform.

12. The structure of claim 11 wherein said center panel is fastened at the bottom to said edge of said platform.

13. A playground deck comprising, a platform having a peripheral edge and being supported by corner posts which extend above said platform, a corner panel at each corner post and each corner panel including wing portions extending along adjacent edges of said platform and defining a passageway onto and off said platform formed between spaced apart wing portions on each side of said platform, said platform including two platform sections, one edge of each section being adjacent a common vertical plane, said edges being supported by a pair of common posts, said common posts including a corner panel with a wing portion of each of said corner panels being spaced apart and extending in said common vertical plane thereby defining therebetween a passageway interconnecting said platform sections to provide an enlarged platform area and each of said common posts including a single panel, said corner panels and said single panels of said common posts providing wing-like portions extending in three directions from each common post.

14. The structure of claim 13 wherein said single panel is in overlapped relationship to said corner panel and is secured to said common post by common fasteners.

15. The structure of claim 14 wherein fasteners at the top end of said common posts include a blind fastener portion inside said common post and a male bolt portion extending through said single panel and one wing section of the corner panel into said post and engagement with said blind fastener portion and at the platform a bolt extends from the outer side of the post through the inner post wall, corner panel, single panel and the adjacent downwardly extending flange on the platform, and a nut means engage the inner bolt end inwardly of the downwardly extending flange.

16. The structure of claim 13 wherein said platform sections are in a common horizontal plane.

17. A playground deck comprising, a platform having a peripheral edge and being supported by corner posts which extend above said platform, a corner panel at each corner post and each corner panel including wing portions extending along adjacent edges of said platform and defining a passageway onto and off said platform formed between spaced apart wing portions on each side of said platform, said platform including two platform sections, one edge of each section being adjacent a common vertical plane, said edges being supported by a pair of common posts, said common posts including a corner panel with a wing portion of each of said corner panels being spaced apart and extending in said common vertical plane thereby defining therebetween a passageway interconnecting said platform sections to provide an enlarged platform area, and at least one of said passageways including, a removable center panel substantially closing said passageway, said center panel including a plate bracket extending adjacent the top and including oppositely disposed end portions overlapping said adjacent wing panels and being secured thereto by removable fasteners therethrough and the bottom of said center panel being secured by removable fasteners adjacent said edge of said platform.

18. A playground deck comprising, a platform supported by four corner posts which extend above said platform, a corner panel at each corner post and each corner panel including wing portions extending along adjacent sides and defining a passageway onto and off said platform being formed between spaced apart wing portions on each side of said platform, said post, platform, and corner panels being made of metal and said posts being square for matingly engaging one wing portion of said corner panels, said metal platform including a flat top surface integral with downwardly extending flanges on each side secured by fasteners to said metal posts, and said flanges including horizontal inwardly extending portions which terminate in upwardly and horizontally outwardly extending end portions which present a rounded free edge for minimizing injuries to users of the equipment.

19. The structure of claim 18 wherein said corner panels of sheet metal include a rod extending along the peripheral edge thereof to present a rounded surface to minimize the presence of sharp edges injurious to the users of the equipment.

20. The structure of claim 18 wherein one of said passageways is in communication with a slide having its upper end supported by said platform and its lower end supported by the ground, and a second passageway is in communication with steps having their upper end supported by said platform and the lower end supported by the ground, and a third passageway includes a removable center panel secured to said platform at its lower end and to adjacent wing portions of associated corner panels at its top end and said center panel substantially closes said passageway.

21. The structure of claim 20 wherein said platform includes two platform sections in side-by-side relationship with common sides being supported by a pair of common posts.

22. The structure of claim 21 wherein each of said common posts include a corner panel and a single panel providing wing-like portions extending in three directions from each common post with said single panel being in overlapped relationship to said corner panel and being secured to said common post by common fasteners.

23. The structure of claim 22 wherein fasteners at the top end of said common posts include a blind fastener portion inside said common, post and a male bolt portion extending through said single panel and one wing section of the corner panel into said post and engagement with said blind fastener portion and at the platform a bolt extends from the outer side of the post through the inner post wall, corner panel, single panel and the downwardly extending flange on the platform, and a nut means engage the inner bolt end inwardly of the downwardly extending flange.

24. The structure of claim 22 wherein said common sides includes a wing portion of each of said corner panels, said wing portions being oppositely disposed therebetween a passageway interconnecting said platform sections to provide an enlarged platform area.

* * * * *